United States Patent [19]

Cosby

[11] Patent Number: 4,698,845

[45] Date of Patent: Oct. 13, 1987

[54] SHOCK ABSORBING ATHLETIC EQUIPMENT WITH PROTECTIVE PADS

[76] Inventor: Finton G. Cosby, P.O. Box 281, Stockbridge, Mass. 01262

[21] Appl. No.: 868,714

[22] Filed: May 30, 1986

[51] Int. Cl.[4] ..... A41D 13/00

[52] U.S. Cl. ..... 2/2

[58] Field of Search ..... 2/2

[56] References Cited

U.S. PATENT DOCUMENTS

| | | | |
|---|---|---|---|
| 1,600,410 | 9/1926 | Hartman | 2/2 |
| 1,915,754 | 6/1933 | O'Shea | 2/2 |
| 2,540,952 | 2/1951 | Kennedy | 2/2 |
| 3,087,163 | 4/1963 | Kelly | 2/2 |
| 3,528,106 | 9/1970 | Austin | 2/2 |
| 4,481,679 | 11/1984 | Hayes | 2/2 |

*Primary Examiner*—Louis K. Rimrodt

*Attorney, Agent, or Firm*—William E. Pelton

[57] ABSTRACT

Protective shock absorbing athletic equipment is presented in the form of a shoulder pad having a plurality of hard shell portions and elongated bumper pads extending along peripheral edges of the shell portions. The shell portions are secured together at a spacing no greater than a predetermined distance so that an impacting object, such as a helmet, is prevented from intruding between the shell portions by the bumpers. Belts for securing the shoulder pad around the chest area of the wearer lift the shoulder portions off the wearer's shoulders so that a hit received on the shoulder portions is transferred to the chest area.

7 Claims, 4 Drawing Figures

SHOCK ABSORBING ATHLETIC EQUIPMENT WITH PROTECTIVE PADS

FIELD OF THE INVENTION

This invention relates generally to shock absorbing athletic equipment and more specifically relates to shock absorbing athletic wear for providing increased protection from large area impact.

BACKGROUND OF THE INVENTION

Protective athletic equipment such as shoulder pads, rib protectors, and hip or thigh pads are commonly worn by participants in many types of sports for protection from shock resulting from forceful contact with the ground or another participant. In such sports as football, it is also common for the players to wear hard protective helmets which provide a rigid enclosure to protect the head. When two players collide, the impact from the helmet worn by one player against the body of the other imparts a significant and potentially damaging shock.

One conventional type of protective athletic equipment has relatively rigid shells designed to cover and protect specific areas of the body. The shells are connected by straps or lacings and may have an inner liner of soft padding material. The hard shells receive the impact of a hit and spread it over a large area to be absorbed and cushioned by the padding material.

It has been found, however, that this structure is not fully effective in cushioning the shock from the impact of a hard object such as a helmet. Firstly, the helmet hitting the rigid shells creates an instantaneous impulsive shock much more damaging than the average force calculable from the momentum of impact. Secondly, when the helmet is forcibly intruded between the shells, the shock is not cushioned at all. These sudden shocks create a significant risk of serious physical injury.

Furthermore, conventional shoulder pads have rested on and in contact with the player's shoulders, so that when the player is hit by an opponent or hits a dummy during practice the full shock of the impact is received on the shoulders. Even so-called "cantilever" pads include a weight bearing strap extending across the shoulder which cause the force of impact to be felt directly thereon. As is well known, the shoulder area is particularly prone to injury in the form of dislocation or bruising. Such injuries are not only painful, but are at least temporarily and possibly permanently disabling. Thus, conventional shoulder pads are insufficient to protect the vulnerable shoulder area.

OBJECTS AND SUMMARY OF THE INVENTION

It is an object of the present invention to provide improved shock absorbing athletic equipment which avoids the above-described difficulties of the prior art.

It is a further object of the present invention to provide improved shock absorbing athletic equipment which reduces the instantaneous force felt at the moment of impact and which reduces the risk of physical injury caused thereby.

It is yet a further object of the present invention to provide improved shock absorbing athletic equipment designed to receive the impact of a helmet on bumper pads and to prevent the intrusion of the helmet between the pads.

It is still a further object of the present invention to provide improved shock absorbing athletic equipment in the form of a shoulder pad which transfers the impact of a hit from the shoulder area to the chest and back area.

It is another object of the present invention to provide an improved shock absorbing shoulder pad which is adapted to dissipate and transfer to the wearer's chest and back area the impact of a force incident on the shoulder pad.

It is yet another object of the present invention to provide an improved shock absorbing shoulder pad which reduces the weight borne on the wearer's shoulders.

In accordance with an aspect of the present invention, there is provided improved shock absorbing athletic equipment for protecting a wearer from forces created by an externally impacting object of predetermined dimension, comprising a plurality of rigid shell portions secured together to form a protective garment designed generally to cover and protect at least a portion of the wearer's body, facing edges of at least two of the shell portions being spaced apart by at most a predetermined distance when the equipment is being worn, and resilient elongated bumper pads extending along the facing edges of the at least two shell portions and protruding outwardly therefrom, the predetermined distance between the facing edges being less than the predetermined dimension so that the impacting object is prevented by the pads from intruding between the facing edges.

In accordance with another aspect of the present invention, there is provided an improved protective shoulder pad comprising left and right shell portions designed to cover and protect a wearer's left front rib or chest area, shoulder area and back rib area, and right front rib or chest area, shoulder area and back rib area, respectively, the left and right shell portions having respective front and back lower portions adapted to overlie the front and back rib areas, respectively, first fastening means for flexibly fastening the left and right front lower portions across the wearer's sternum area, and second fastening means for flexibly fastening the left and right back lower portions across the wearer's back area. The novel shoulder pad further comprises a left belt assembly including first and second buckling means affixed to the left front lower portion and the left back lower portion, respectively, and left belt means separably receivable in the first and second buckling means at a plurality of positions and adapted to pass well below the wearer's left arm for adjustably connecting the left front and back lower portions, and a right belt assembly including third and fourth buckling means affixed to the right front lower portion and the right back lower portion, respectively, and right belt means separably receivable in the third and fourth buckling means at a plurality of positions and adapted to pass well below the wearer's right arm for adjustably connecting the right front and back lower portion, the left and right shell portions having respective convexly configured shoulder portions which, when the left and right belt means are secured to bring all the lower portions into close conformity with the wearer's body, are at a spacing from the wearer's shoulders of at least approximately one half inch and are firmly supported thereat to substantially maintain the spacing when receiving an externally applied force.

DETAILED DESCRIPTION OF THE PREFERRED EMBODIMENTS

Figure 1:
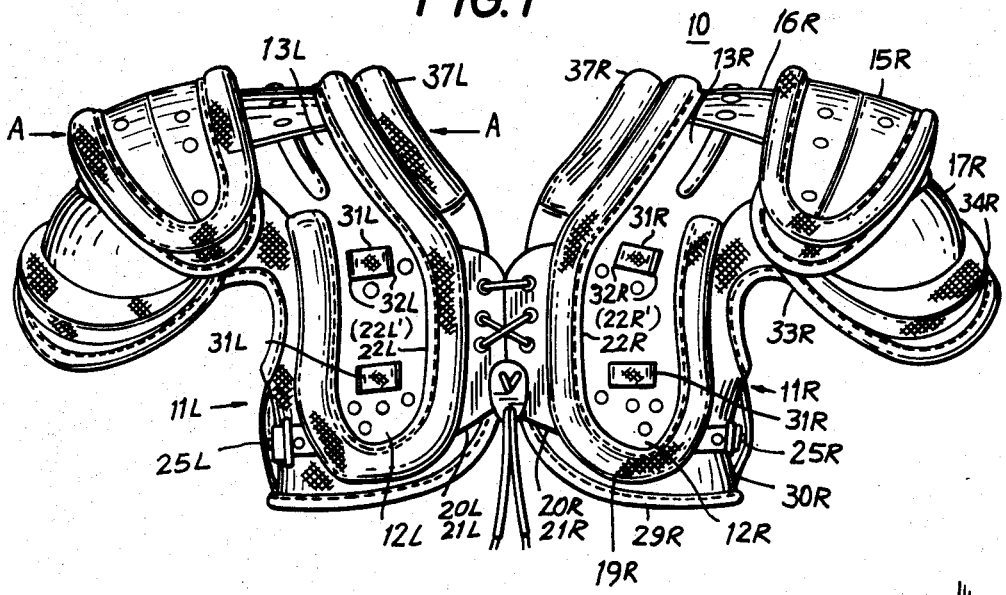
FIG. 1 is a front view of a first embodiment of a shoulder pad according to the present invention.
Figure 2:
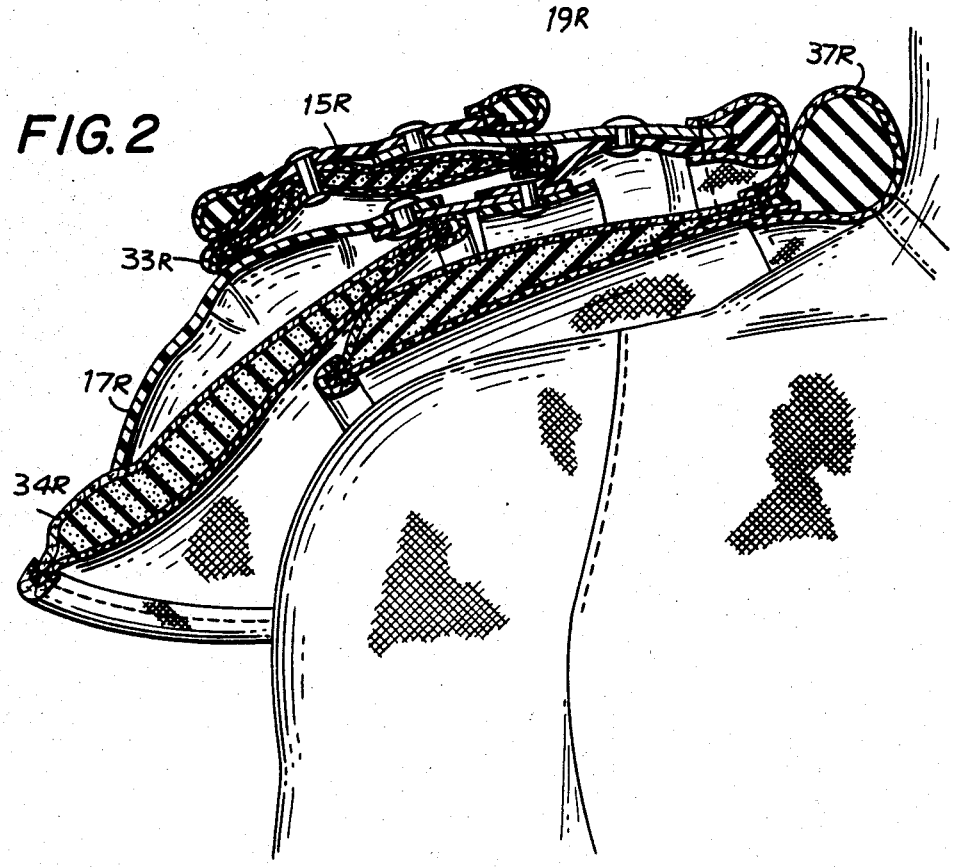
FIG. 2 is a cross-sectional view of the shoulder pad of FIG. 1 taken along line A—A.

Referring now to the drawings, and initially to FIG. 1 thereof, the novel athletic equipment according to the present invention is illustrated in the form of an improved shoulder pad 10 having left and right shells 11L, 11R. Left shell 11L is adapted to extend over the wearer's left front rib or chest, shoulder and back rib areas, while right shell 11R is adapted to extend over the wearer's right front rib or chest, shoulder and back rib areas. Shells 11L, 11R are specially contoured to provide increased protection for the shoulder area, as will be described below.

The left and right sides of shoulder pad 10 are symmetrical, and elements identified as forming part of the right side of shoulder pad 10 have corresponding elements forming the left side of shoulder pad 10. Furthermore, the front and back halves of shoulder pad 10 are symmetrical, with corresponding front and back elements. In the following discussion, a detailed description will be given of the construction of the front right side of shoulder pad 10, with reference to corresponding elements of the left side and back when necessary. It will be understood, of course, that the same description of the structure and effect of the front right side of shoulder pad 10 applies to the structure and effect of the front left side of shoulder pad 10, while the back right and left sides have the same description as the front right and left sides.

Referring now in detail to the construction of the right side of shoulder pad 10, shell 11R is molded of a high impact plastic, advantageously 140 gauge polyethylene. Shell 11R will nevertheless flex slightly upon impact to absorb shock. While shell 11R is of unitary construction, it may be conceptually divided into a front lower portion 12R (FIG. 1), a shoulder portion 13R and a back lower portion 14R (FIG. 4), respectively adapted to cover the wearer's front rib or chest, shoulder and back rib areas. An epaulet 15R is also formed of high impact plastic and is joined to shoulder portion 13R by a strap 16R. Strap 16R is rivetted to shoulder portion 13R and to epaulet 15R and is made of belting material, advantageously two layers of polyurethane material laminated over and under a layer of fabric. A cup 17R is similarly attached to shoulder portion 13R by a strap or hinge 18R (see FIG. 4) rivetted thereto and to shoulder portion 13R. Cup 17R is also formed of high impact plastic and strap or hinge 18R is made of the belting material. Epaulet 15R lies over and rests upon cup 17R, which extends slightly outwardly therefrom to enclose and cover the wearer's shoulder area and the top of the upper arm. The flexibility of straps or hinges 16R and 18R allows displacement of epaulet 15R and cup when the arms of the player are raised and when receiving the impact of a hit from another player and helps to absorb the shock.

In accordance with an important aspect of the present invention, shell 11R is provided with an elongated bumper pad 19R which extends along the peripheral edges of shell 11R from just under the outer edge of shoulder portion 13R, completely around the edge of front lower portion 12R, the inner edge of shoulder portion 13R, the edge of back lower portion 14R and up to just below the outer edge of shoulder portion 13R. Bumper pad 19R is advantageously made of horsehide with a rubber filler and overlaps the outer and inner surfaces of shell 11R and is sewn thereto to enclose the edge therewithin. A lacing flap 20R, together with a corresponding lacing flap 20L, forms a lacing which flexibly fastens shells 11R, 11L across the wearer's sternum area. A second lacing formed of lacing flaps 21R, 21L flexibly fastens the back lower portions 14R, 14L across the wearer's back area. A sternum bumper 22R of bumper pad 19R is that portion which extends along the inner edge of front lower portion 12R, and is adapted to parallel the wearer's sternum. Sternum bumper 22R lies outside of and slightly overlaps lacing flap 20R.

When shoulder pad 10 is worn and properly secured, as discussed below, right sternum bumper 22R is spaced from the corresponding left bumper portion 22L by approximately two inches across the wearer's sternum and left and right shells 11L, 11R are spaced from the wearer's chest by approximately $\frac{3}{4}$ inch. This novel construction provides a highly advantageous effect. It frequently happens during the course of play or practice that a collision brings one player's helmet into forceful contact with the second player's chest. The front of the chest and the sternum are particularly prone to injury because they do not have protection from the ribs, as do the side and back areas. When the rigid helmet impacts against the hard shell areas of conventional protective equipment or intrudes directly onto the body, the shock can cause serious injury. However, the structure of shoulder pad 10 according to the present invention provides sternum bumpers 22R, 22L with a maximum separation considerably smaller than the diameter of a conventional helmet. It is thus virtually impossible for any part of the helmet to hit between sternum bumpers 22R, 22L onto the wearer's fragile sternum area.

Corresponding bumper portions 22R', 22L' along the inner edges of back lower portions 14R, 14L are also spaced apart by a maximum of approximately two inches. Furthermore, portions of bumpers 19R, 19L extending around the lower and outer edges of the front lower portions 12R 12L, as well as those portions extending along the edges of back lower portions 14R, 14L, are also sufficiently close to make it unlikely that the helmet will hit the area of shell 11R exposed between bumpers 19R, 19L.

Although the bumpers have been described in connection with a shoulder pad for extra protection of the wearer's sternum area, it will be appreciated that such elongated bumpers may be advantageously be used whenever a plurality of shell portions are secured together to form a protective garment. Such protective garments may include entire body armor suits and hip and thigh protectors among others.

Figure 4:
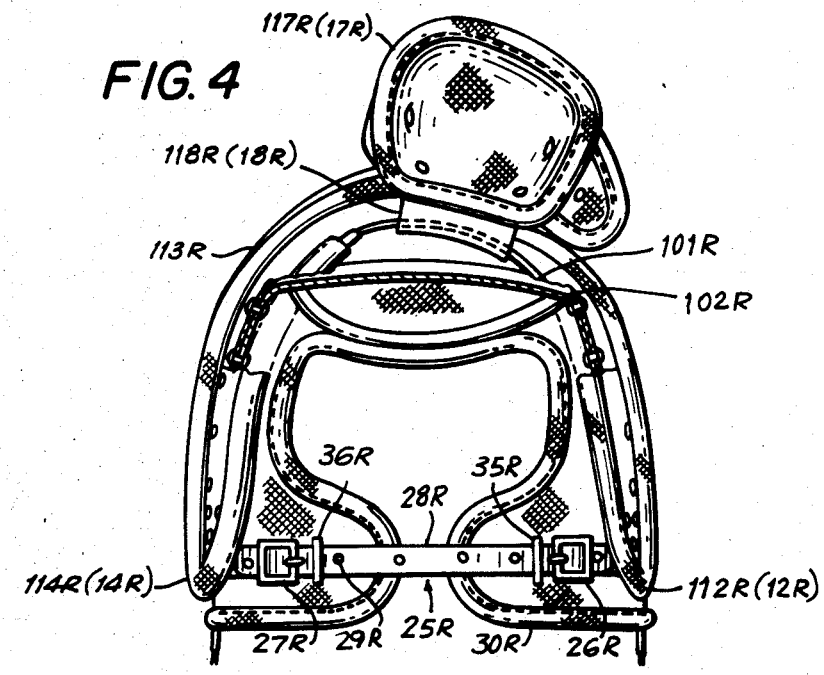
FIG. 4 is a side cross-sectional view of the shoulder pad of FIG. 3.

In accordance with a second important aspect of the present invention, belt assemblies 25R and 25L are provided for adjustably securing shoulder pad 10 around the wearer's rib area to lift the specially configured shoulder portions 13R, 13L of shoulder pad 10 out of contact with the wearer's shoulders. This reduces the impact felt by the shoulders and transfers the impact to the less vulnerable chest and back area. Since belt assemblies 25R and 25L are identical in both preferred embodiments of the present invention, reference will be made to FIG. 4, which illustrates the second embodiment, using the reference numerals of the first embodiment (FIG. 1) for the purposes of this part of the description only. As illustrated in FIG. 4, belt assembly 25R includes a first buckle 26R mounted by rivets on the lower outer edge of front lower portion 12R. Buckle 26 advantageously includes a metal buckler mounted on the belting material discussed above. A second buckle 27R of similar construction is mounted by rivets on the outer lower edge of back lower portion 14R. A buckling belt 28R, advantageously made of the same belting material, is separably received and held by first and second buckles 26R, 27R. Belt 28R has a number of belt holes 29R, each adapted to receive the tongue of the buckler of first or second buckle 26R, 27R to be secured in any one of a number of positions for fitting to the wearer. By selecting the appropriate belt holes 29R for first and second buckles 26R, 27R, right belt assembly 25R and the corresponding left belt assembly 25L may be tightly adjusted to bring the front lower portions 12R, 12L and back lower portions 14R, 14L into close conformity with the wearer's body.

Figure 3:
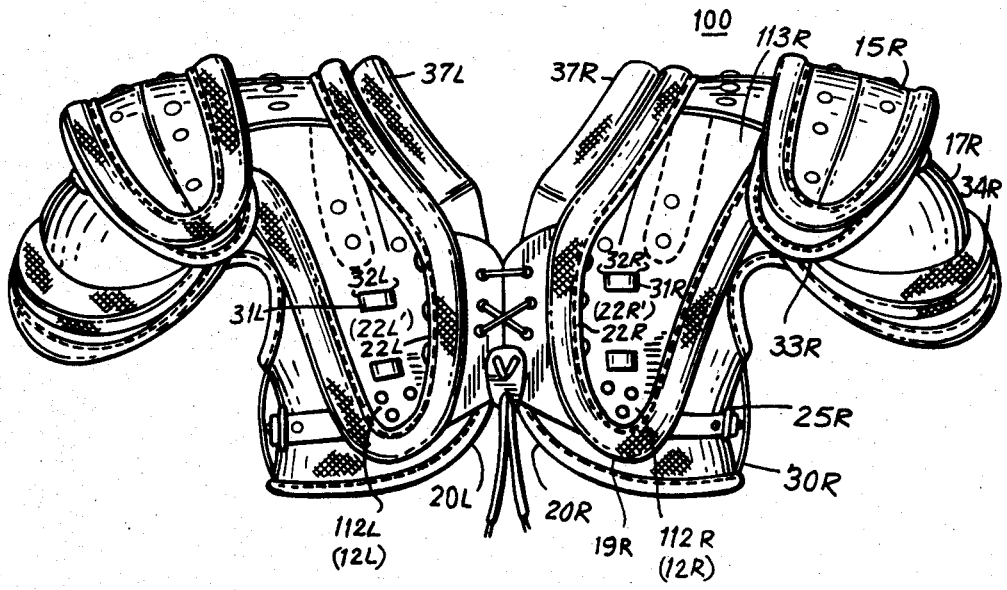
FIG. 3 is a front view of a second embodiment of a shoulder pad according to the present invention.

Shoulder portion 13R has a special convex configuration, as illustrated in FIG. 3. When belt assemblies 25R, 25L are adjusted so as to bring lower portions 12R, 12L, and 14R, 14L into close conformity with the wearer's body, shoulder portion 13R does not rest on or make contact with the wearer's shoulder. Instead, it is contoured to rise above and outwardly from the shoulder to be spaced therefrom by at least approximately one half an inch and to be spaced ¾ of an inch from the chest and back areas. The tighter belt assembly 25R is fastened, the higher shoulder portion 13R is lifted from the shoulder. Belt assembly 25R is designed to be worn as snugly as possible. Thus, it is belt assemblies 25R, 25L which support shoulder pad 10 from the wearer's lower torso. When the wearer receives a hit on shoulder portion 13R, the force of the hit is first blunted by the inherent flexibility in the raised section of the shell and is not transmitted therethrough to the wearer's shoulders. Rather, the raised portion of the shell above the shoulders is prevented from moving downwardly against the shoulder because the belt assembly 25R acts substantially as a pivot to transfer the forces of the impact from the shoulder area to the torso. The torso, being resiliently adapted to absorb such inward pressure, may receive the pressure from the hit with a significantly reduced risk of injury. Even during full impact, shoulder portion 13R is maintained securely above and at a spacing from the wearer's shoulders. This reduces the risk of bruising and dislocation which conventional shoulder pads do not prevent.

The combined effect of belts 25R, 25L and shoulder portions 13R, 13L is to lift the weight of shoulder pad 10 from the wearer's shoulders. This distributes the weight of shoulder pad 10, which is approximately 5 lbs, 12 oz., about the wearer's body, enabling the weight to be more easily carried because it feels lighter and freeing the arms and shoulders.

A further advantageous feature of belt assembly 25R is that belt 28R is a completely separable unit and is therefore replaceable. If, for example during play, belt 28R was torn, it would take only a matter of seconds to replace it with a new strap.

Shoulder pad 10 according to the present invention includes additional advantageous features. A padded liner 29R with a side extension 30R is provided to underlie shell 11R. Liner 29R extends beyond the outer and lower edges of shell 11R to provide a cushioning effect for hits received both on shell 11R and on the wearer's side. Liner 29R is filled with sealed cell rubber, having nitrogen bubbles inside to uniformly absorb the shocks. Such sealed cell rubber does not absorb moisture. However the cloth covers of such liners become stained and damaged after extensive use, and so liner 29R is made separate from shell 11R, and is removeably attached thereto by means of a number of fastening strips 31R. A corresponding number of aperture slits 32R are provided at spaced positions on front and back lower portions 12R, 14R of shell 11R, and fastening strips 31R may be threaded through aperture slits 32R and fastened together to hold liner 29R to shell 11R. Advantageously, fastening strips 31R have Velcro® portions at the ends for secure and easily removable fastening.

Upper and lower liners 33R, 34R are provided underneath and rivetted to epaulet 15R and cup 17R, respectively. As the liners 33R, 34R do not engage with the wearer's body in the same way as liner 29R, they will not be as damaged by perspiration, and so it is unnecessary to make them removeable. Of course, removeable liners may be used if desired.

Front and back belt loops 35R, 36R are provided on side extension 30R of liner 29R to define a path for belt 28R. When belt 28R is securely fastened, belt loops 35R, 36R prevent liner 29R from creeping up and bunching under the wearer's right arm. Front and back belt loops 35L, 36L are provided on the left side for the same purpose.

A neck roll 37R is adapted to fit closely, but without pressure, around the wearer's neck. This prevents the neck from being stretched sideways, which stretches nerves and tendons and can cause disabling injury. Conventional shoulder pads leave about two to three fingers depth between the neck and the pad. Neck roll 37R is advantageously made of a 1½ inch rubber roll covered with horsehide, which may be fitted smoothly over the roll without wrinkles. Neck roll 37R should not be covered with vinyl, since vinyl is difficult to form smoothly over the rubber roll. The horsehide is first glued to the rubber roll and then sewn to liner 29R. While neck roll 37R stabilizes the neck, it does not prevent the wearing of a neck collar or neck brace if the player has previously been injured.

A second embodiment of the athletic equipment according to the present invention is illustrated in FIGS. 3 and 4. Shoulder pad 100 is identical in many respects to shoulder pad 10, and like elements in these two embodiments have been given like reference numerals. Shoulder pad 100 has a "cantilever" feature. A second arch 101R (FIG. 4) is provided in shoulder portion 113R and a cantilever strap 102R spans the space below second arch 101R. Cantilever strap 102R is advantageously formed of the belting material described above. Cantilever strap 102R is positioned to be out of contact with the wearer's shoulders and to be held out of contact even when the shoulder pad 100 received an external hit. Lower end portions 112R, 112L (FIG. 3) narrow down in a V-shaped configuration, permitting more freedom of movement than does shoulder pad 10, which offers a corresponding increase in protective area.

Those skilled in the art will recognize that many modifications, other than those specifically mentioned above, can be made without departing from the present invention. Therefore, the scope of the present invention should be determined from the appended claims.

I claim:

1. A protective shoulder pad comprising:

left and right shell portions designed to cover and protect a wearer's left front rib area, shoulder area and back rib area, and right front rib area, shoulder area and back rib area, respectively;

said left and right shell portions having respective front and back lower portions adapted to overlie the front and back rib areas, respectively;

first fastening means for flexibly fastening the left and right front lower portions across the wearer's sternum area;

second fastening means for flexibly fastening the left and right back lower portions across the wearer's back area;

left belt assembly means including first and second buckling means affixed to said left front lower portion and said left back lower portion, respectively, and left belt means separably receivable in said first and second buckling means at a plurality of positions and adapted to pass under the wearer's left arm for adjustably connecting said left front and back lower portions; and right belt assembly means including third and fourth buckling means affixed to said right front lower portion and said right back lower portion, respectively, and right belt means separably receivable in said third and fourth buckling means at a plurality of positions and adapted to pass under the wearer's right arm for adjustably connecting said right front and back lower portion;

said left and right shell portions having respective convexly configured shoulder portions which, when said left and right belt assembly means are secured to bring all said lower portions into close conformity with the wearer's body, deviate outwardly from conformity with the wearer's body to be at a spacing from the wearer's shoulders of at least approximately one half inch and are firmly supported thereat, said left and right shell portions being adapted when receiving an externally applied force to pivotally transfer said force to said left and right belt means acting as pivots to substantially maintain said spacing even when receiving said externally applied force.

2. A shoulder pad according to claim 1, wherein said shell portions are molded of high impact plastic.

3. A shoulder pad according to claim 2, wherein said plastic is 140 gauge polystyrene.

4. A shoulder pad according to claim 1, further comprising neck roll means extending inwardly of said shoulder portions and adapted to closely conform to the wearer's neck to limit sideways motion thereof.

5. A shoulder pad according to claim 4, wherein said neck roll means includes left and right neck rolls affixed to said left and right shoulder portions, respectively, each said neck roll being a roll of resilient padding material covered with horsehide.

6. A shoulder pad according to claim 1, further comprising:

left and right padded liners adapted to underlie said left and right shell portions, respectively, and each having a plurality of fastening strips attached thereto;

said left and right shell portions having a corresponding plurality of slit apertures through which said fastening strips may be passed for removably securing said left and right liners to said left and right shell portions, respectively.

7. A shoulder pad according to claim 1 wherein facing inner edges of said left and right front lower portions are spaced apart by at most a predetermined distance when said shoulder pad is being worn; said shoulder pad further comprising:

resilient elongated bumper pads extending along said facing inner edges and protruding outwardly therefrom, said predetermined distance between said facing inner edges being less than a predetermined dimension of an externally impacting object, said bumper pads preventing said impacting object from intruding therebetween.

* * * * *